United States Patent [19]

Miller

[11] 4,355,527

[45] Oct. 26, 1982

[54] HOLD DOWN MECHANISM

[75] Inventor: Donald E. Miller, Mount Prospect, Ill.

[73] Assignee: The Continental Group, Inc., Stamford, Conn.

[21] Appl. No.: 206,330

[22] Filed: Nov. 12, 1980

[51] Int. Cl.[3] ..... B21D 22/00

[52] U.S. Cl. ..... 72/351; 72/347; 72/450; 269/234

[58] Field of Search ..... 72/350, 351, 347, 450; 269/234, 239

[56] References Cited

U.S. PATENT DOCUMENTS 2,140,658 12/1938 Van Sittert ..... 269/234 X 2,154,983 4/1939 LeJeune ..... 72/350 X

*Primary Examiner*—Leon Gilden

*Attorney, Agent, or Firm*—Charles E. Brown

[57] ABSTRACT

This disclosure relates to a hold down mechanism which is particularly adapted to apply a preselected hold down pressure on an element. It employs a bar which is pivotally mounted on a support member with the bar having a hold down surface thereon so positioned that when the bar is pivoted in a selected direction the hold down surface will engage the element in clamping relation and further pivoting of the bar in the same direction will result in the shifting of the pivot point for the bar from the pivot member to the hold down surface. The pivot member is spring loaded for lifting movement at this time with an associated spring pack providing for a controlled loading by the hold down surface against the element. A movable cam member having a wedge shaped lower end moves between a cam follower carried by the arm and a fixed cam follower to effect the controlled pivoting of the bar.

13 Claims, 11 Drawing Figures

HOLD DOWN MECHANISM

This invention relates in general to a new and useful improvement in hold down mechanisms, and more particularly to a hold down mechanism operable to clamp in place a flange of an impact extrusion molding die assembly for forming flanged containers.

In many press arrangements there is provided a work retaining flange which must be held in place under a predetermined loading. At the same time such a flange is movable with the ram of the press so as to permit clearance relative to the remainder of the die assembly to permit the positioning of the material from which an article is to be formed in the die assembly and also to permit discharge of the formed article from the die assembly.

Normally the flange is held down or clamped in place by means of suitable spring means or by fluid actuated means. In the past, however, difficulties have been encountered in maintaining the desired clamping action on the flange.

In accordance with this invention, it is proposed to provide a mechanical hold down mechanism which is actuated by the descending ram so as first to move a hold down arm into engagement with the flange and thereafter resiliently to load that arm so that the hold down force exerted by the arm is entirely resilient even though the actuation of the arm is entirely mechanical.

Most specifically, in accordance with this invention there is provided a hold down arm which is pivotally mounted on a pivot member and which has a hold down surface for engaging the flange. The pivot member is carried by a carrier for movement upwardly away from its associated support with the carrier being restrained against such upward movement by suitable spring means. The arm is provided with a hold down surface which engages the flange after limited pivoting of the arm, after which continued pivoting of the arm is about the hold down surface with the result that the pivot member is moved against the resistance of the spring means relative to the support so that the clamping force exerted by the hold down arm on the flange is entirely controlled by the spring loading of the spring means.

In accordance with this invention, the arm carries a cam follower which normally opposes a fixed cam follower carried by the support. The ram carries a depending cam member having a lower part of a wedge configuration with that lower part being movable in between the two cam followers as the ram descends, effecting pivoting of the arm about the pivot member and the actuation of the hold down mechanism. The effective stroke of the cam member is such so as to effect pivoting of the arm first about the pivot member to engage the hold down surface with the flange and then about the hold down surface to activate the spring means holding the pivot member normally fixed relative to the support.

Another feature of the invention is the mounting of the cam member so that the lower end thereof is generally aligned with the space between the two cam followers while permitting the cam member to pivot as one cam surface thereof rides against the fixed cam follower.

Another feature of the invention is the mounting of the cam follower so that it may be vertically adjusted with respect to the ram so as to permit adjustment of the cam spacing relative to the die assembly in accordance with the product being formed.

A further feature of the cam member is that after full pivoting of the arm is effected, movement of the cam member relative to the arm may continue without further displacement of the arm.

With the above and other objects in view that will hereinafter appear, the nature of the invention will be more clearly understood by reference to the following detailed description, the appended claims, and the several views illustrated in the accompanying drawings.

Figure 1:
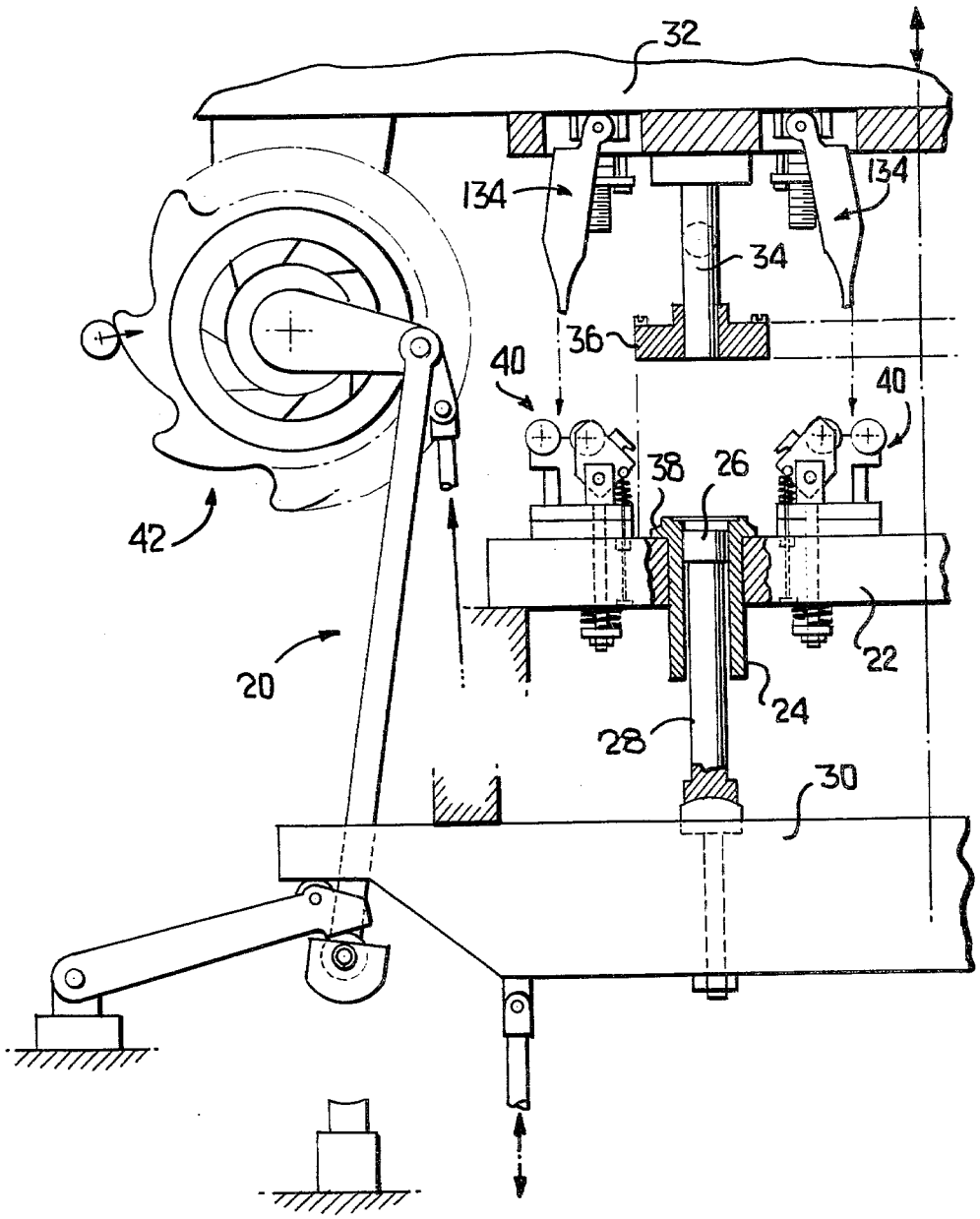
FIG. 1 is a schematic side elevational view of a press structure incorporating the hold down mechanism, parts being broken away and shown in section.

Referring now to the drawings in detail, it will be seen that there is illustrated in FIG. 1 a press structure, generally identified by the numeral 20, incorporating the hold down mechanism of this invention. It is to be understood that the illustrated press structure is only one of the many environments in which the hold down mechanism can be utilized. The illustrated press mechanism includes a fixed frame member 22 which carries a fixed die sleeve 24 which has received therein for vertical movement a die pad 26. The die pad 26 is carried by a rod 28 which has its lower end secured to a load beam 30.

The press 20 includes a ram 32 which, in turn, carries a punch 34 and a flange 36 for vertical movement, the ram 32 being actuated by a conventional crank mechanism (not shown).

It is to be understood that after a slug of material to be extruded and deformed is placed in the upper part of the die sleeve 24 and seated on the die pad 26, the ram 32 is moved downwardly first to seat the flange 36 on an upper flange portion 38 of the die sleeve 24, after which the punch 34 engages the slug and applies sufficient force thereon to effect sideward extrusion to form at one end of a tubular body (container) a radially outwardly directed flange as will be described in detail hereinafter.

Figure 2:
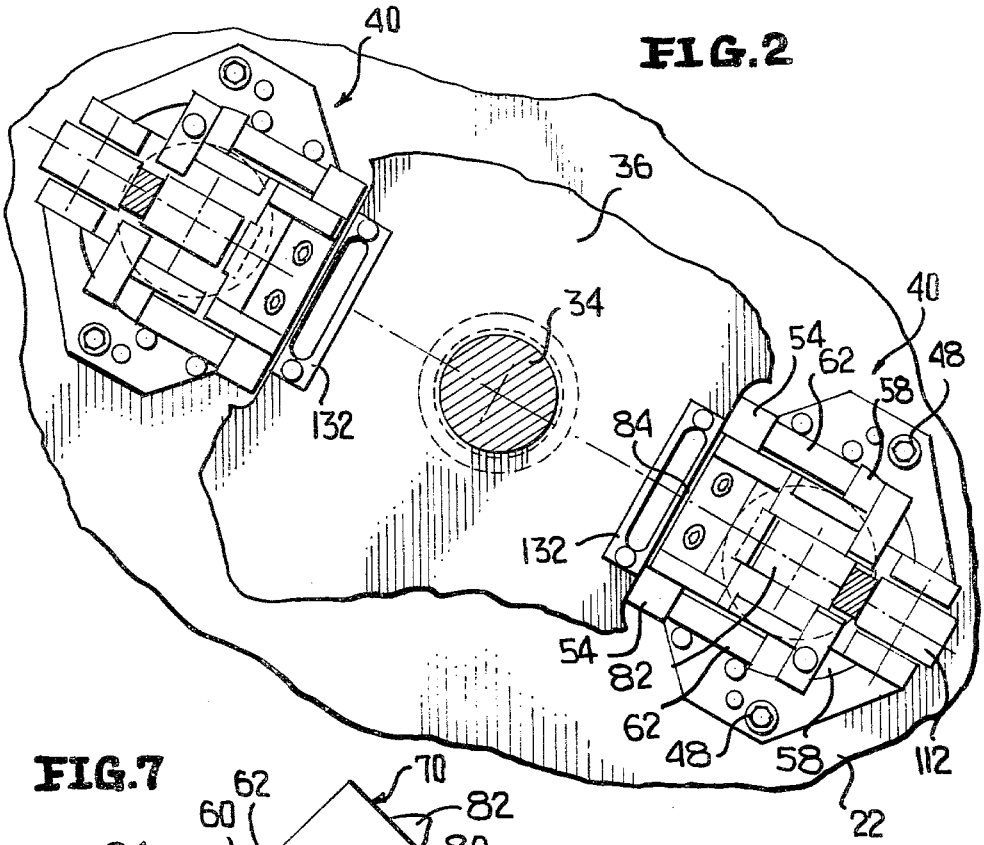
FIG. 2 is a fragmentary horizontal view showing the general details of a pair of hold down mechanisms associated with a die assembly flange and an associated punch being shown in section.

In accordance with this invention, it is necessary that the flange 36 be tightly clamped against the flange portion 38 under a minimum clamping force. It is further desired that the clamping force be mechanically actuated with the actuation being effected by a downward movement of the ram 32. To this end there is carried by the frame member 22 a pair of hold down mechanisms 40 which are disposed in diametrically opposite relation with respect to the die sleeve 24. While it does not form a part of this invention, to provide suitable clearances for other operations the hold down mechanism 40 are disposed in angular relation with respect to both the longitudinal and transverse axes of the press 20, as is shown in FIG. 2.

Also, although it forms no part of this invention, it is to be understood that normally the press illustrated in FIG. 1 will have two die sets with the result that there will be two sets of hold down mechanisms 40.

In addition, it is pointed out that a suitable connecting mechanism, generally identified by the numeral 42, so interconnects the load beam 30 and the ram 12 so that the ram 32 is drawn down by the load beam 30.

Referring specifically to the invention, it will be seen that each hold down mechanism 40 includes a support, generally identified by the numeral 44, which is seated in a fixed position on the frame member 22. The support 44 includes a base plate 46 which is secured by means of suitable fasteners 48 to the frame member 22. The base plate 46 has mounted on a central portion thereof a block 50 which is suitably secured thereto in a manner not shown. Along opposite edges of the block 50 is a guide unit 52. Each guide unit 52 includes an upstanding guide bar 54 which is secured at its lower end by a fastener 56 to the block 50. A further upstanding bar 58 is suitably secured to the block 50 in spaced relation to the bar 54 with the upper ends of the bars 54, 58 being secured together by an elongated fastener 60 extending through a spacer 62.

Figure 7:
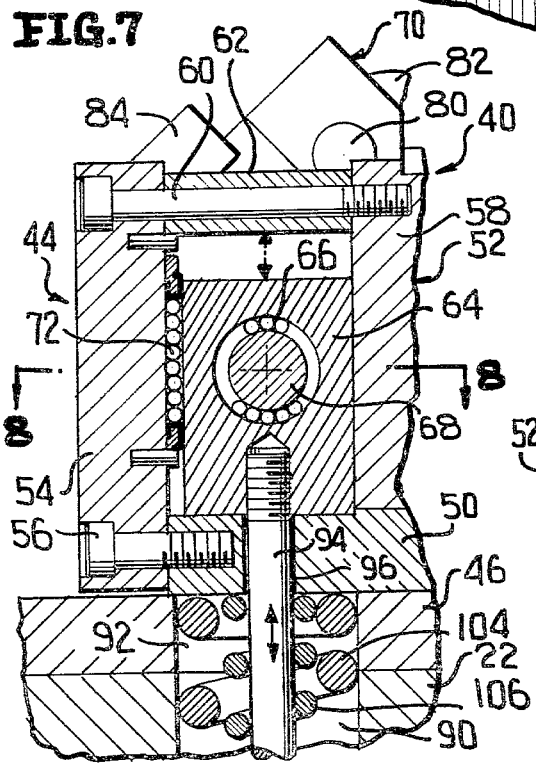
FIG. 7 is an enlarged fragmentary vertical sectional view taken generally along the line 7—7 of FIG. 6, and shows the mounting of the pivot member and carrier relative to the support.

A generally rectangular carriage 64 is mounted for vertical movement within each guide unit 52 and is normally seated on the block 50, as is best shown in FIG. 7. Each carrier 64 has rotatably journalled therein by means of a bearing 66 one end of a stub pivot member 68. The two pivot members 68 are in alignment with one another and carry for pivotal movement an arm, generally identified by the numeral 70.

In order to facilitate vertical movement of each carrier 64 within its associated guide unit 52 while under pressure in a manner to be described hereinafter, a roller assembly 72 is provided between one face of the carrier 64 and an adjacent face of the associated bar 54 as is clearly shown in FIGS. 7 and 8.

Figure 8:
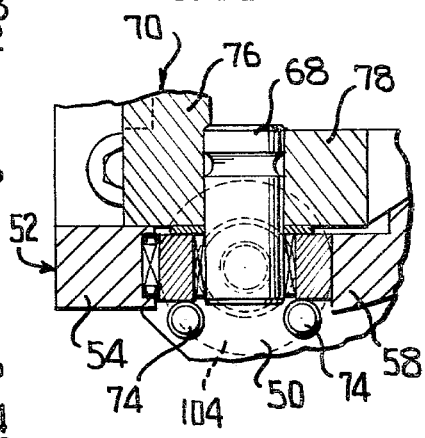
FIG. 8 is a fragmentary horizontal sectional view taken generally along the line 8—8 of FIG. 7, and shows more specficially the mounting of the pivot member.

At this time it is also pointed out that the block 50 carries a pair of upstanding guide pins 74 adjacent the outer face of each carrier 64 so as to retain it within its respective guide member 52 as best shown in FIG. 8.

The arm 70 is of a generally U-shaped cross section and includes a web 76 and a pair of flanges 78. The flanges 78 are guided axially against the inner faces of the respective guide units 52 as shown in FIG. 8.

Figure 9:
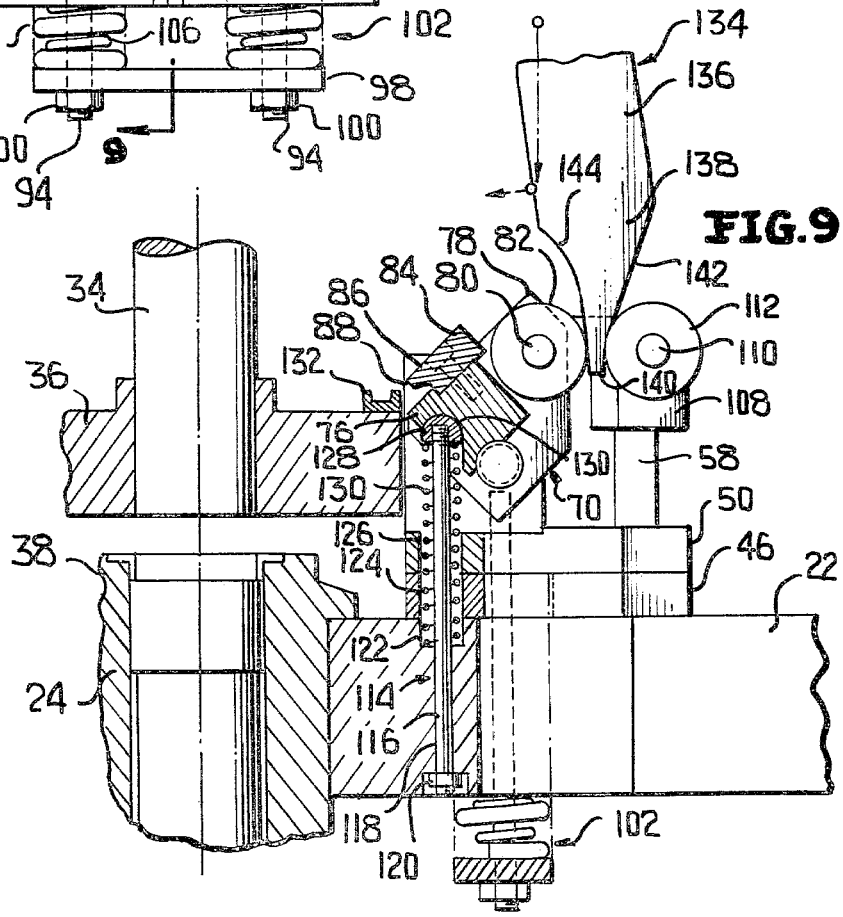
FIG. 9 is a fragmentary sectional view on an enlarged scale taken along the line 9—9 of FIG. 6, and shows the initial relationship of the cam member with respect to the other components of the hold down mechanism as the hold down mechanism is actuated.

The flanges 78 carry a pin 80 which extends therebetween and on which there is mounted for rotation a cam follower 82. The web 76 has secured thereto a hardened hold down member 84 which terminates in the lower outer part thereof in a finger-like projection 86 having a lower hold down surface 88, as is best shown in FIG. 9.

Figure 6:
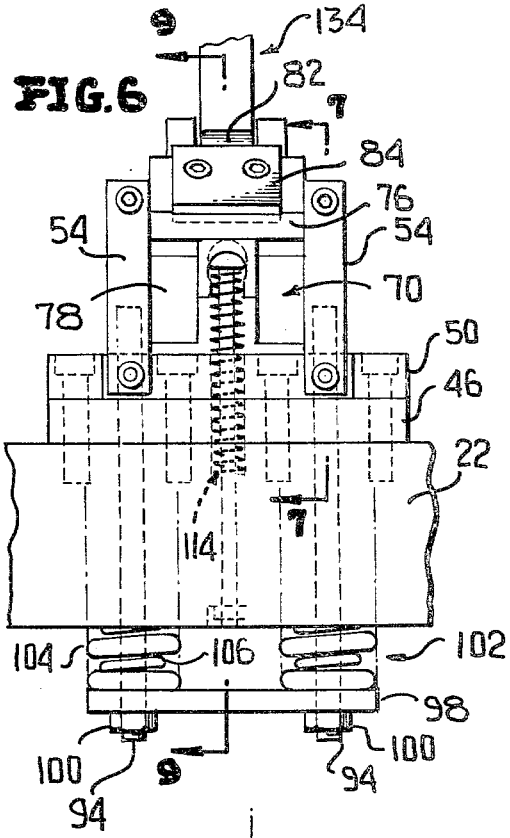
FIG. 6 is a fragmentary side elevational view taken generally along the line 6—6 of FIG. 3, and shows more specifically the details of the hold down mechanism.

Aligned bores 90 and 92 are formed in the frame member 22 and the base plate 46 as is best shown in FIG. 7. A rod 94 has its upper end threaded into the lower part of a respective carrier 64 with the rod extending down through a small diameter bore 96 in the block 50 and then through bores 90 and 92. The lower ends of the rods 94, as is best shown in FIG. 6, carry a connecting strap 98 which is seated on nuts 100 adjustably threaded on the rods 94.

Each rod 94 carries a spring pack 102 which includes an outer spring 104 and an inner spring 106. The lower ends of the springs 104 and 106 are seated on the strap 98 while the upper ends of the springs bear against the underside of the block 50, as shown in FIGS. 6 and 7. Thus the spring packs 102 serve resiliently to clamp the carrier 64 against the block 50 and normally hold the block 50 in the position illustrated in FIG. 7.

The bars 58 also carry a pair of mounting blocks 108 which have extending therebetween a shaft 110 with there being mounted on the shaft 110 between the blocks 108 a fixed cam follower 112. The cam followers 82 and 112 are disposed in aligned opposed relation, as is best shown in FIG. 2.

The arm 70 is constantly urged to move the cam follower 82 to a position immediately adjacent the cam follower 112 by a spring assembly, generally identified by the numeral 114, as is best shown in FIG. 9. The spring assembly 114 includes a rod 116 which is guided in a bore 118 extending through the frame member 22 and being provided at its lower end with a nut 120 which limits the upward movement thereof. The bore 118 has an upper portion 122 of a larger diameter which is aligned with bores 124 and 126 extending through the mounting frame 22 and the plate 46. The upper end of the rod 116 carries a ball element 128 which is seated in a socket 132 formed in the web 76 of the arm 70.

The spring unit 114 further includes an elongated compression spring 130 which has its lower end seated on the frame member 22 and its upper end engaged against the ball member 128. The spring unit 114 thus constantly urges the arm 70, as viewed in FIG. 9, in a counterclockwise direction positioning the movable cam follower 82 adjacent to but spaced from the fixed cam follower 112. The position of the cam follower 82 in the retracted position of the arm 70 is controlled by adjusting the nut 120.

As is clearly shown in FIGS. 2 and 9, the flange 36 carries a pair of socket members 132 which are aligned with the respective hold down mechansims, each socket member 132 being adapted to receive the projecting finger 86 of an associated hold down mechanism.

The ram 32 has depending therefrom cam members, generally identified by the numeral 134, to engage each of the hold down mechanisms 40. Each cam member 134 has a constant width upper portion 136 and a lower tapered wedge portion 138 which terminates in a lowermost narrow starting portion 140. That surface of the cam member 134 which opposes the fixed cam follower 112 is identified by the numeral 142 and is of a straight line configuration. The opposite face of the cam member 134, i.e., the face which opposes the cam follower 82, is identified by the numeral 144 and has a lower straight line portion which blends into an upper arcuate portion of corresponding slope.

Figure 3:
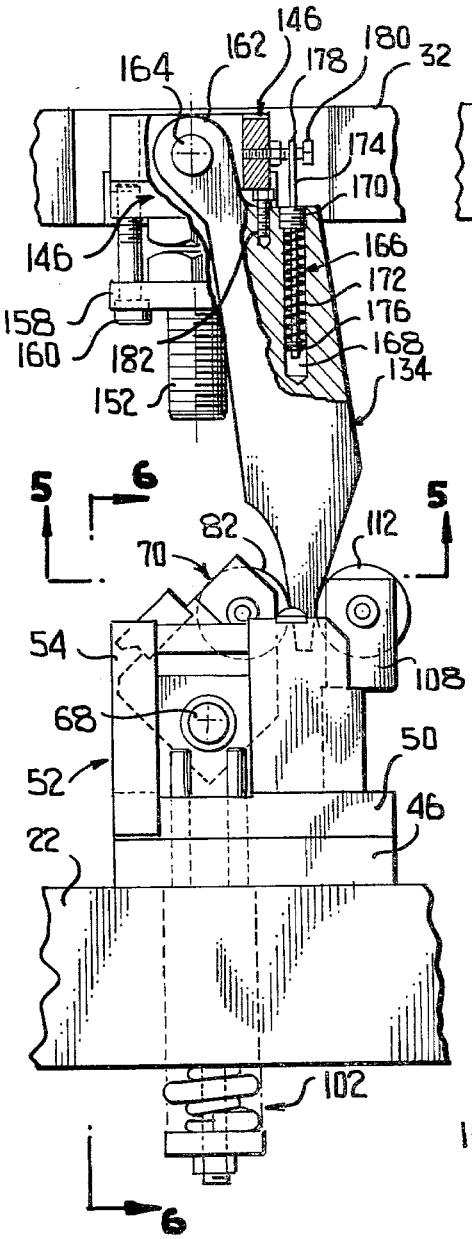
FIG. 3 is a side elevational view of one of the hold down mechanisms and its associated cam member, the cam member being partially broken away and shown in section.
Figure 4:
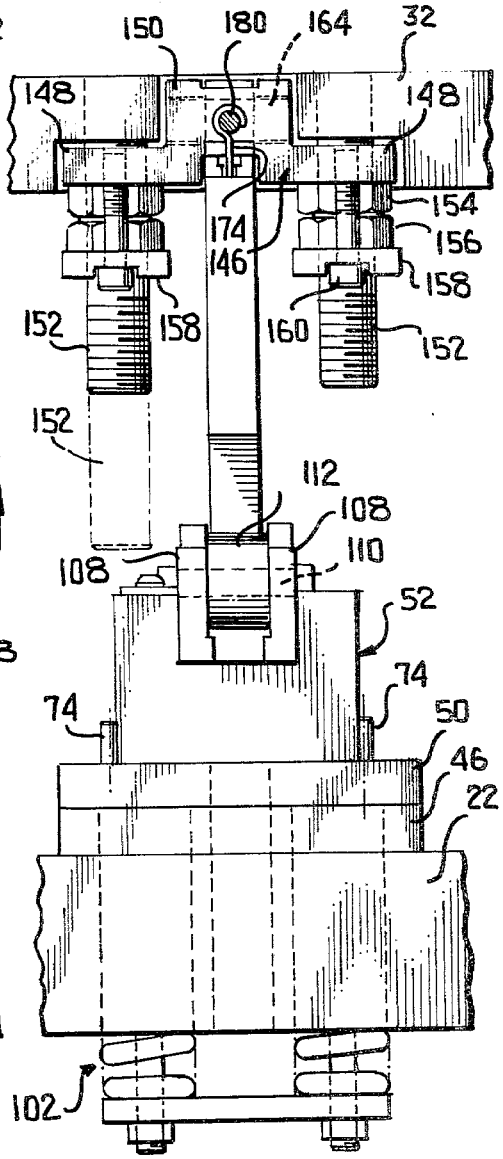
FIG. 4 is a fragmentary elevational view taken generally at right angles to FIG. 3, and shows further the details of the hold down mechanism.
Figure 5:
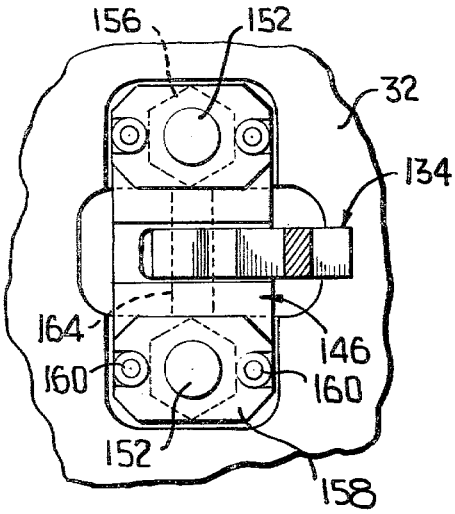
FIG. 5 is a fragmentary horizontal sectional view taken generally along the line 5—5 of FIG. 3, and shows the details of mounting of the cam member.

Each cam member 134 is carried by the ram 32 for vertical adjustment. The mounting for each cam member 134, as is best shown in FIGS. 3–5, includes a mounting bar 146 having a pair of mounting ears 148 and a central web portion 150. The mounting ears 148 are received on threaded rods 152 which depend from the ram 32 and which, when the ram descends to its lowest position, reach the location shown in dotted lines in FIG. 4. Each rod 152 carries a pair of adjustable nuts 154, 156, with the upper nut 154 forming a seat for the respective mounting ear 148 and the lower nut 156 forming a stop element for a clamp bar 158. The clamp bar is secured to the respective mounting ear 148 by a pair of fasteners 160 which clamp the mounting ear 148 against the upper nut 154 and thus provides for a rigid, yet adjustable mounting for the bar 146.

When the die assembly is of the type specifically illustrated, there must be sufficient clearance between the punch 34 in its retracted position and the die sleeve to permit the removal of the formed container. The container may be of different lengths, as desired, and depending upon the length or height of the container, the clearance between the end of the punch and the frame member 22 will vary in accordance with the length of the punch.

The cam member 134 includes an offset mounting ear portion 162 which is pivotally mounted on a pin 164 carried by the offset central portion of the support 146, as is clearly shown in FIGS. 3–5.

It is also necessary that the lowermost portion 140 of the cam member 134 be initially positioned for movement between the cam followers 82 and 112. Accordingly, there is provided a positioning device which is generally identified by the numeral 166. The positioning device 166 includes a vertical bore 168 in the upper part of the cam member 134 with this bore having its upper end closed by a plug 170. A compression spring 172 is disposed within the bore 168 and has extending therethrough a rod 174 with an adjustable stop member 176 on the lower end thereof compressibly engaging the spring 172. The upper end of the rod 174 is in the form of a loop or eye 178 which is engaged over a fastener 180 which is threaded through the support 146.

It will be apparent from FIG. 3 that when the cam member 134 is moved in a clockwise direction, the spring 172 will be further compressed, urging the cam member 134 back to its starting position.

The starting position of the cam member 134 is determined by an adjustable stop member 182 which is threaded onto the upper end of the cam member 134 and projects upwardly therefrom for engaging the central part 150 of the support 146. The lower end of the cam member 134 is accurately positioned by adjusting the stop member 182.

OPERATION

As is best schematically shown in FIG. 9, the ram 32 in the operation of the press 20 moves downardly, moving the punch 34 down toward the die sleeve 24. The flange 36 also moves downwardly for seating engagement on the upper flange portion 38 of the die sleeve. At the time the flange 36 engages the die sleeve 24, or even before, the cam member 134 has its lower part 140 enter in between the cam followers 82, 112. The wedge shaped configuration of the cam member 134 causes the lower part of the cam member 134 to react against the fixed cam follower 112 and to shift to the left, urging the cam follower 82 also to shift to the left, thus pivoting the bar 70 in a counterclockwise direction with the hold down finger 86 moving toward the socket 132.

Figure 10:
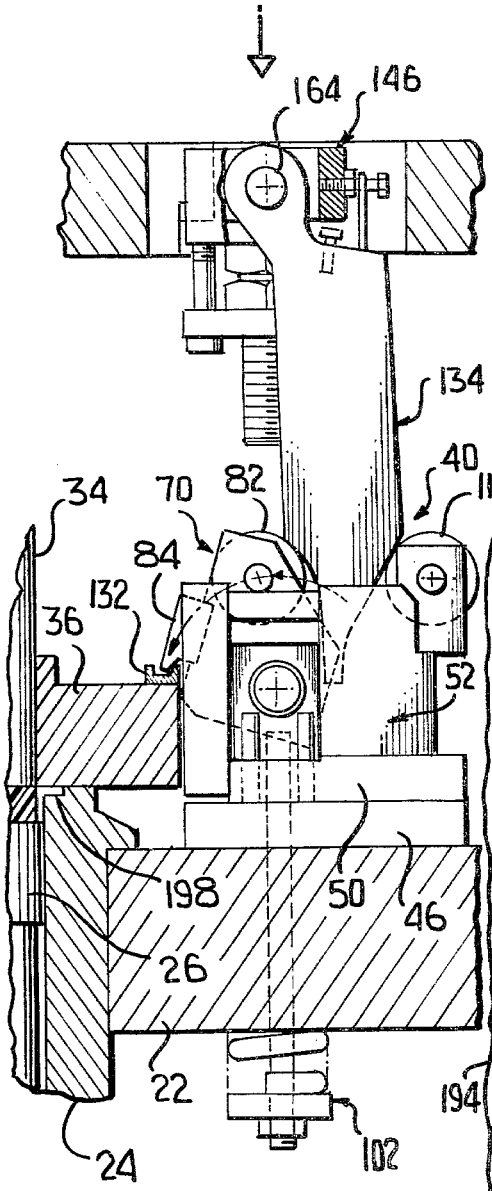
FIG. 10 is a sectional view similar to FIG. 9, and shows the hold down mechanism actuated until the hold down surface engages the associated socket of the flange.
Figure 11:
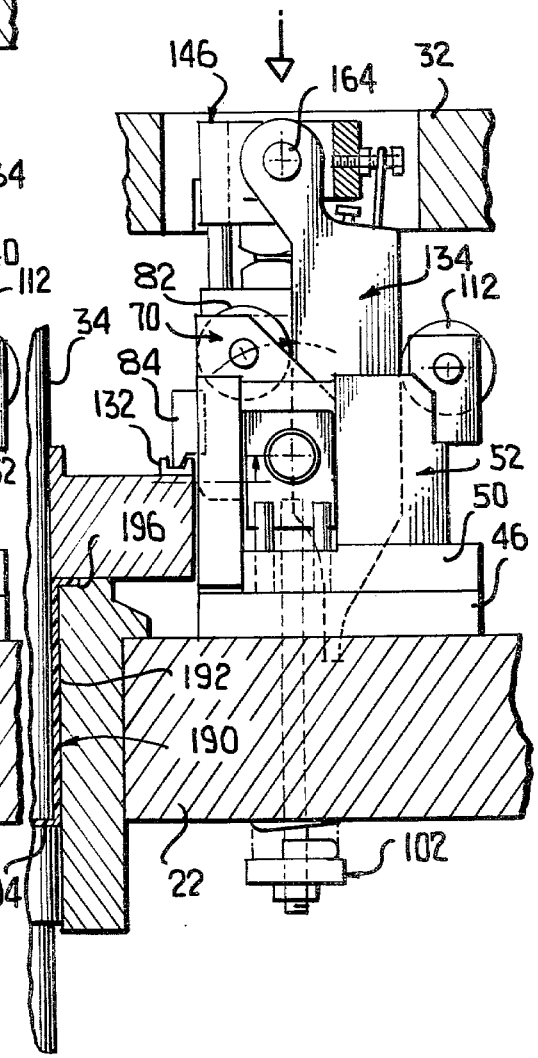
FIG. 11 is another sectional view similar to FIG. 9, and shows the fully actuated position of the hold down mechanism as the cam member and associated ram continue to descend.

Continued downward movement of the ram 32 results in the continued downward movement of the cam member 134 as shown in FIG. 10, and the finger 86 is seated in the socket 132 as is generally shown in FIG. 11. At this time the bar 70 cannot pivot further in a counterclockwise direction and would, if the pivot pin members 68 were fixed, result in a wedging action. However, further downward movement of the cam member 138, while it continues to urge the pivoting of the bar 70 in a counterclockwise direction, results in the shifting of the pivot point from that defined by the pivot members 68 to that defined by the hold down surface 88. Thus, as the cam member 82 continues to move to the left from the position shown in FIG. 10 to the position shown in FIG. 11, the finger 86 cannot move down further and thus the pivot members 66 and the carriers 64 move upwardly within the guide units 52 relative to the pivot therefor. This upward movement results in the spring loading of the bar 70 by the spring packs 102. Thus, there is a spring loaded holding down of the flange 36 separate and apart from the mechanical action of the cam member 138. The spring loading of the bar 70 and the shifting of the pivot assures a full clamping of the flange 36 by the hold down mechanism 40 without there being a jamming action. It will be seen that when there has been full movement of the cam follower 82, the spacing between the cam followers 82, 112 is equal to the width of the constant width upper portion 136 of the cam member 134 and the cam member 134 is free to continue downwardly with the ram 32 and the punch 34 without further pivoting of the bar 70.

When the article forming operation is complete, the ram 32 will retract, withdrawing the cam member 138 with the spring packs 102 first pulling the pivot members 68 and the carriers 64 back down to their original positions and then the spring unit 114 urging the bar 70 in a clockwise direction to move the hold down finger 86 out of the socket 132, thus releasing the flange 36.

As the cam member 138 continues to move upwardly with the ram 32, the spring unit 166 will effect pivoting of the cam member 134 in a counterclockwise direction back to its starting position controlled by the stop 182.

At this time, with particular reference to FIG. 11, it will be seen that the press 20 is forming a tubular container, generally identified by the numeral 190, which includes a cylindrical body 192, an integral bottom wall 194 and an upper seaming flange 196. The seaming flange is formed by extruding the material into a recess 198 (FIG. 10) having the upper end closed by the flange 36. If the flange 36 is not held against the flange portion 38 of the die sleeve 24 with sufficient clamping pressure, an improper flange 196 will be formed.

Although only a preferred embodiment of the hold down mechanism has been specifically illustrated and described herein, it is to be understood that minor variations may be made without departing from the spirit and scope of the invention as defined by the appended claims.

I claim:

1. A hold down mechanism for clamping in place an element, said mechanism comprising a support positioned adjacent the intended clamped position of said element, a carrier mounted in said support for guided movement away from said support in a controlled direction generally parallel to but opposite to an intended direction of clamping force on said element, resilient means reacting on said carriage opposite to said controlled direction for resiliently seating said carriage on said support, a pivot member extending transversely of said controlled direction and being mounted on said carriage for movement therewith in said controlled direction against the restraint of said resilient means, a hold down arm carried by said pivot member for swinging movement between a retracted position and an element clamping position, a hold down surface projecting from said arm for clamping engagement with said element, and actuating means engageable with said arm for first pivoting said arm about said pivot member to engage said hold down surface with said element and effect clamping of said element in place and then pivoting said arm about said hold down surface while moving said carrier and pivot member in said controlled direction against the resistance of said resilient means to apply a resilient predetermined clamping force against said element.

2. The hold down mechanism of claim 1 wherein said actuating means is a cam member mounted for relative movement with respect to said support, and said arm carries a cam follower for engagement with said cam member.

3. The hold down mechanism of claim 2 wherein said hold down surface is disposed to that side of a line between said pivot member and said cam follower remote from said cam member and generally intermediate said cam follower and said pivot member.

4. The hold down mechanism of claim 2 wherein the relationship of said pivot member, said hold down surface and said cam follower is one wherein when said hold down surface engages said element said cam follower is displaced in said controlled direction beyond said hold down surface away from said support wherein further pivoting of said arm is about said hold down surface.

5. The hold down mechanism of claim 2 wherein said cam member is generally in the form of a tapered wedge, and there is a fixed reacting guide generally opposing said cam follower and being cooperable with said cam member for transferring all camming action to said cam follower.

6. The hold down mechanism of claim 5 wherein there are mounting means mounting said cam member for pivotal movement as required by engagement of said cam follower with said fixed guide.

7. The hold down mechanism of claim 2 wherein said mechanism is part of a press including a ram and wherein said element is a work retaining flange.

8. The hold down mechanism of claim 2 wherein said mechanism is part of a press including a ram and wherein said element is a work retaining flange, and said cam member is carried by said ram for movement therewith.

9. The hold down mechanism of claim 8 wherein said cam member is generally in the form of a tapered wedge, and there is a fixed reacting guide generally opposing said cam follower and being cooperable with said cam member for transferring all camming action to said cam follower.

10. The hold down mechanism of claim 1 together with other resilient means engaging said arm for constantly urging said cam to said retracted position.

11. The hold down mechanism of claim 1 wherein said hold down surface is in the form of a projection and said element has a socket receiving said finger for limited transverse sliding movement.

12. The hold down mechanism of claim 2 wherein said cam member is generally in the form of a tapered wedge, and there is a fixed reacting guide generally opposing said cam follower and being cooperable with said cam member for transferring all camming action to said cam follower, that surface of said wedge engaging said fixed guide being substantially straight and that surface of said wedge engaging said cam follower being arcuate and increasing in slope.

13. The hold down mechanism of claim 6 wherein said mounting means for said cam member includes adjustment means for adjusting the position of said cam member relative to said ram generally in said controlled direction in accordance with an axial dimension of an article being formed.

* * * * *